US010941756B2

(12) United States Patent
Hida

(10) Patent No.: US 10,941,756 B2
(45) Date of Patent: Mar. 9, 2021

(54) COMPRESSOR

(71) Applicant: DENSO TEN Limited, Kobe (JP)

(72) Inventor: Masashi Hida, Kobe (JP)

(73) Assignee: DENSO TEN Limited, Kobe (JP)

( * ) Notice: Subject to any disclaimer, the term of this patent is extended or adjusted under 35 U.S.C. 154(b) by 89 days.

(21) Appl. No.: 16/367,613

(22) Filed: Mar. 28, 2019

(65) Prior Publication Data

US 2020/0072202 A1 Mar. 5, 2020

(30) Foreign Application Priority Data

Aug. 31, 2018 (JP) ..... JP2018-163478

(51) Int. Cl.
*F04B 9/02* (2006.01)
*F04B 35/04* (2006.01)

(52) U.S. Cl.
CPC ..... *F04B 9/02* (2013.01); *F04B 35/04* (2013.01)

(58) Field of Classification Search
CPC ..... F04B 9/02; F04B 9/04–047; F04B 17/03; F04B 35/01; F04B 35/04
USPC ..... 417/415; 74/10.39, 422
See application file for complete search history.

(56) References Cited

U.S. PATENT DOCUMENTS

2017/0028968 A1* 2/2017 Kubota ..... F04B 39/0005

FOREIGN PATENT DOCUMENTS

JP 2017-119480 A 7/2017
WO 2015/159763 A1 10/2015

* cited by examiner

*Primary Examiner* — Charles G Freay
*Assistant Examiner* — Chirag Jariwala
(74) *Attorney, Agent, or Firm* — Oliff PLC

(57) ABSTRACT

A compressor includes: a case, a piston, an elastic member, and a drive. The piston in the case moves along an axis direction. The elastic member in the case applies a force to the piston to move the piston in the axis direction toward a first side of the case. The drive causes the piston to move in the axis direction toward a second side of the case. The piston includes a rack extending in the axis direction. The drive includes: a motor, and a pinion that rotates in accordance with the motor, and that is engaged with the rack. The pinion includes: first and second toothed regions each having a pinion tooth; and first and second flat regions having no pinion tooth. A number of the pinion teeth formed on the first toothed region is greater than a number of the pinion teeth formed on the second toothed region.

6 Claims, 16 Drawing Sheets

COMPRESSOR

BACKGROUND OF THE INVENTION

Field of the Invention

The invention relates to a compressor that compresses fluid.

Description of the Background Art

An on-vehicle camera has been known that is mounted on a vehicle, such as a car, to capture an image of a surrounding of the vehicle. The image captured by the on-vehicle camera is displayed on a display in a cabin of the vehicle.

An object, such as a water drop, a snowflake, dirt, dust and mud is sometimes on a lens of the on-vehicle camera. An attached object removal apparatus that removes the object attached on the lens has been known. The attached object removal apparatus ejects compressed air toward the lens of the on-vehicle camera to remove the attached object.

The attached object removal apparatus includes a compressor and a nozzle. The compressor generates the compressed air by causing a rotary motion of a rotating body inside a cylinder. The nozzle ejects the generated compressed air toward the lens of the camera.

There is a case in which the attached object removal apparatus repeatedly ejects the compressed air while the attached object removal apparatus is removing the attached object from the lens of the camera. In that case, it is recommended that an ejection amount of the compressed air should be changed because a change in the ejection amount of the compressed air makes the attached object easier to remove.

However, in the case where the ejection amount of the compressed air is changed, there is a problem in that the attached object removal apparatus needs to perform a more complicated motor control to cause the rotary motion of the rotating body. Specifically, in the case where the ejection amount of the compressed air is changed, a rotary amount of the rotating body needs to be changed. Moreover, in a case where the attached object removal apparatus generates the compressed air again after generating the compressed air by the rotary motion of the rotating body, the attached object removal apparatus needs to perform a control to cause the rotating body to return to an initial position.

SUMMARY OF THE INVENTION

According to one aspect of the invention, a compressor includes: a case, a piston, an elastic member, and a drive. The piston is housed in the case, and moves along an axis direction. The elastic member is housed in the case, and applies a force to the piston to move the piston in the axis direction toward a first side of the case. The drive causes the piston to move in the axis direction toward a second side of the case. The second side is opposite the first side. The piston includes a rack that extends in the axis direction. The drive includes: a motor and a pinion. The pinion rotates in accordance with a rotary motion of the motor, and is engaged with the rack. The pinion includes: a first toothed region and a second toothed region each on which a pinion tooth is formed; and first and second flat regions on which no pinion tooth is formed, the first and second flat regions being provided between the first and second toothed regions. A number of the pinion teeth that are formed on the first toothed region is greater than a number of the pinion teeth that are formed on the second toothed region.

Since the number of the pinion teeth formed on the first toothed region is greater than the number of the pinion teeth formed on the second toothed region, a distance that the piston moves in a case of the first toothed region is greater than a distance that the piston moves in a case of the second toothed region. Thus, the distance that the piston moves can be changed by controlling the motor to cause the pinion to make one turn. Accordingly, it is possible to change an amount of ejected fluid by a simple control.

According to another aspect of the invention, the pinion teeth formed on the first toothed region include a movement prevention tooth having a tooth tip that contacts a rack tooth after the motor has been stopped at a predetermined position in the axis direction. The rack tooth is formed on the rack. A length in a circumferential direction of the pinion of the tooth tip of the movement prevention tooth is greater than a length in the circumferential direction of the pinion of a tooth tip of at least one of the pinion teeth other than the movement prevention tooth formed on the first toothed region.

Thus, even if a contact position of the movement prevention tooth with the rack tooth is different from a predetermined position, the piston can be stopped in an initial position.

These and other objects, features, aspects and advantages of the invention will become more apparent from the following detailed description of the invention when taken in conjunction with the accompanying drawings.

DESCRIPTION OF THE EMBODIMENTS

Figure 1:
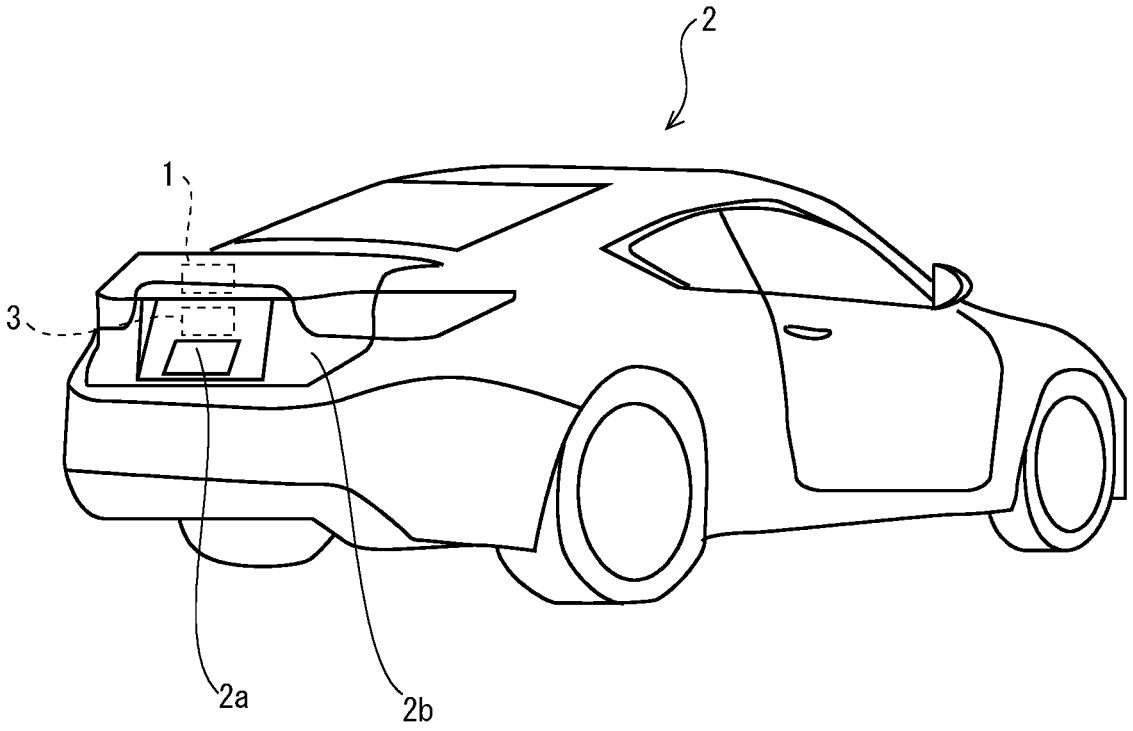
FIG. 1 is a perspective view of a vehicle on which an attached object removal apparatus having a compressor of this embodiment is mounted.

An embodiment of this invention will be described below in detail with reference to the drawings. Same reference numerals will be given to same or corresponding parts/portions in the drawings, and explanation of those parts/portions will be omitted.

1. Configuration of an Attached Object Removal Apparatus 1

FIG. 1 is a perspective view of a vehicle 2 on which an attached object removal apparatus 1 is mounted. As illustrated in FIG. 1, the vehicle 2 includes the attached object removal apparatus 1 and a camera 3. The attached object removal apparatus 1 and the camera 3 are mounted, for example, above a license plate 2*a* of the vehicle 2 and in a substantial center of a left-right direction of the vehicle 2.

The attached object removal apparatus 1 includes a compressor 1A (see FIG. 2) of this embodiment. Details of the compressor 1A will be described later. The attached object removal apparatus 1 removes an object attached on a lens of the camera 3. Examples of the attached object are a water drop, a snowflake, dirt, dust and mud, etc. More specifically, the attached object removal apparatus 1 removes the object attached on the lens of the camera 3 by ejecting compressed air generated by the compressor 1A, toward the lens.

The camera 3 captures and generates an image of an area behind the vehicle 2, and outputs the generated image to a display installed in a cabin of the vehicle 2. A driver of the vehicle 2 can see the area behind the vehicle 2 by watching the images displayed on the display.

The attached object removal apparatus 1 removes the attached object not only from the camera 3, but may remove the attached object also from any optical sensor that acquires, via the lens, information of an object in a vicinity of the vehicle 2. Some examples of the optical sensors are a front camera that captures an image of an area in front of the vehicle 2, and a side camera that captures an image of an area on a left side or a right side of the vehicle 2, and a radar apparatus that detects a target in the vicinity of the vehicle 2.

Figure 2:
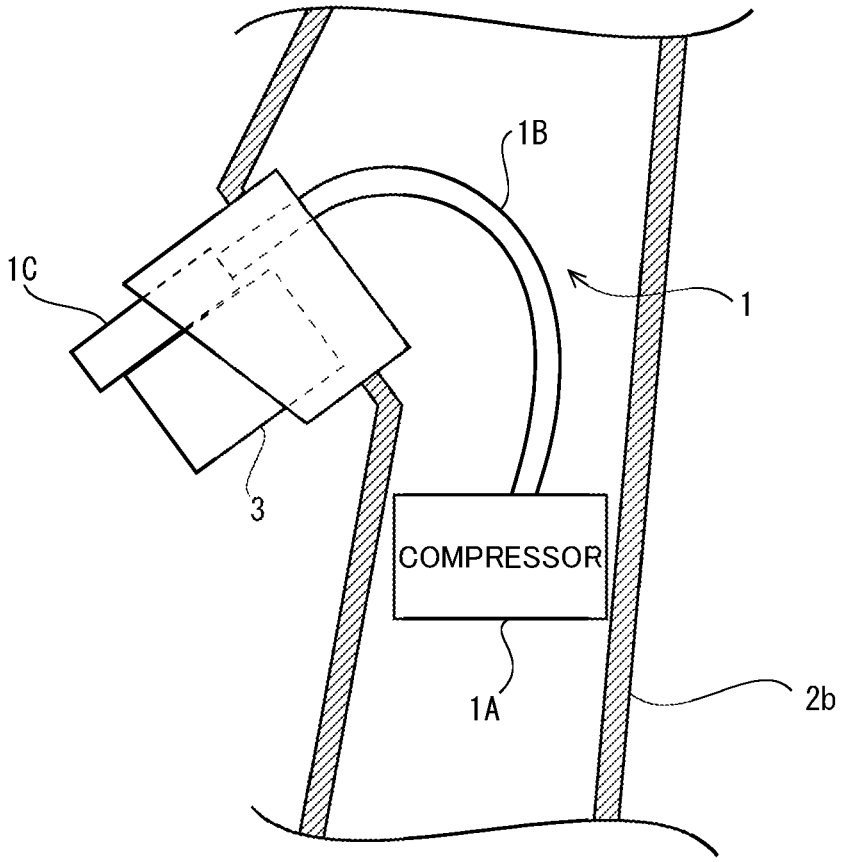
FIG. 2 illustrates an example of a positional relationship between the attached object removal apparatus and a camera illustrated in FIG. 1.

FIG. 2 illustrates an example of a positional relationship between the attached object removal apparatus 1 and the camera 3 illustrated in FIG. 1. As illustrated in FIG. 2, the camera 3 is installed on a rear panel 2*b* of the vehicle 2 such that an optical system including the lens is seen from an outside of the vehicle 2.

The attached object removal apparatus 1 includes the compressor 1A, a hose 1B and a nozzle 1C. The compressor 1A generates the compressed air to remove the object attached on the lens of the camera 3. The compressor 1A is placed inside the rear panel 2*b*. The hose 1B supplies the compressed air generated by the compressor 1A to the nozzle 1C. The nozzle 1C ejects the compressed air supplied via the hose 1B toward the lens of the camera 3.

Figure 3:
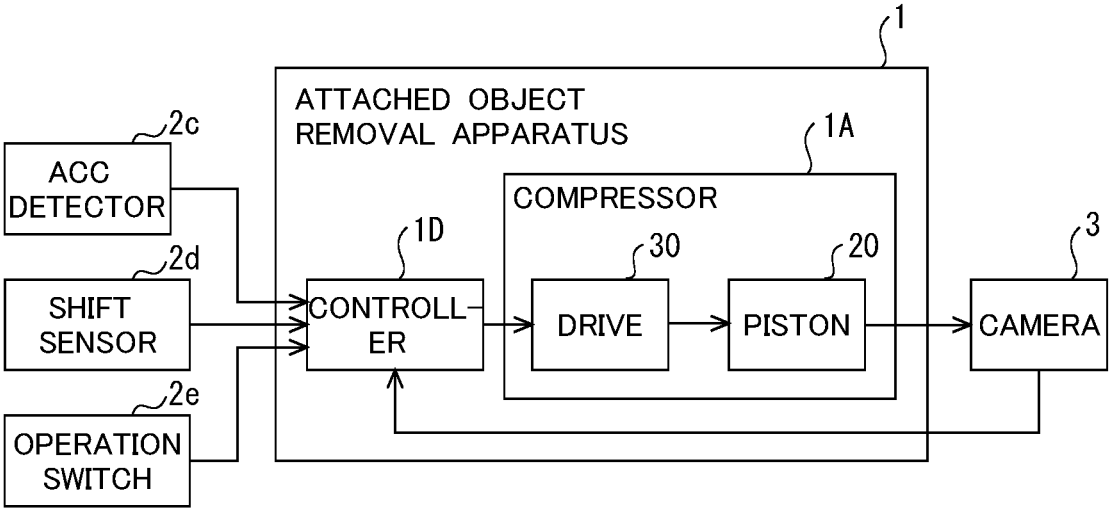
FIG. 3 is a functional block diagram illustrating a configuration of the attached object removal apparatus illustrated in FIG. 1.

FIG. 3 is a functional block diagram illustrating a configuration of the attached object removal apparatus 1 illustrated in FIG. 1. As illustrated in FIG. 3, the attached object removal apparatus 1 further includes a controller 1D. The controller 1D controls the compressor 1A. The hose 1B and the nozzle 1C are not illustrated in FIG. 3.

The compressor 1A includes a piston 20 and a drive 30. The piston 20 is used to generate the compressed air that is described later. The drive 30 drives the piston 20 based on a control signal from the controller 1D.

The controller 1D is a microcomputer, and includes a Central Processing Unit (CPU), a Random Access Memory (RAM), and a nonvolatile memory, not illustrated. The controller 1D is connected to an ACC detector 2*c*, a shift sensor 2*d*, an operation switch 2*e*, and the camera 3.

When an ACC (accessory power source) is turned on, the ACC detector 2*c* outputs, to the controller 1D, a signal indicating that the ACC is On. The shift sensor 2*d* outputs, to the controller 1D, a signal indicating a position of a gearshift, not illustrated. Examples of the position of the gearshift are "drive position" for forward moving of the vehicle 2 and a "reverse position" for backward moving of the vehicle 2. The operation switch 2*e* is installed in the cabin of the vehicle 2. When the driver of the vehicle 2 desires removal of the attached object by the attached object removal apparatus 1, the driver operates the operation switch 2*e*.

When the controller 1D receives, from the ACC detector 2*c*, the signal indicating that the ACC is On, the controller 1D controls the drive 30 to work and eject the compressed air toward the camera 3. Thus, the object attached on the lens of the camera 3 is removed, for example, while the vehicle 2 is being stopped.

When the controller 1D receives, from the shift sensor 2*d*, the signal indicating the gearshift position for backward moving of the vehicle 2, the controller 1D controls the drive 30 to work. Thus, it is possible to clean a view of the camera 3 when the vehicle 2 starts to move backward.

When the controller 1D receives, from the operation switch 2*e*, a signal indicating that the operation switch 2*e* has been operated, the controller 1D controls the drive 30 to work. Thus, the driver of the vehicle 2 can remove the object attached on the camera 3 at a time at which the driver desires.

The controller 1D analyzes the image generated by the camera 3, and determines whether or not an object is on the lens of the camera 3. In a case where the controller 1D determines that the object is on the camera 3, the controller 1D controls the drive 30 to work. Thus, the object attached on the camera 3 can be removed early.

The controller 1D may control the drive 30 to work based on at least one of the ACC detector 2*c*, the shift sensor 2*d*, the operation switch 2*e*, and the image generated by the camera 3.

2. Configuration of the Compressor 1A 2.1. Outline

Figure 4:
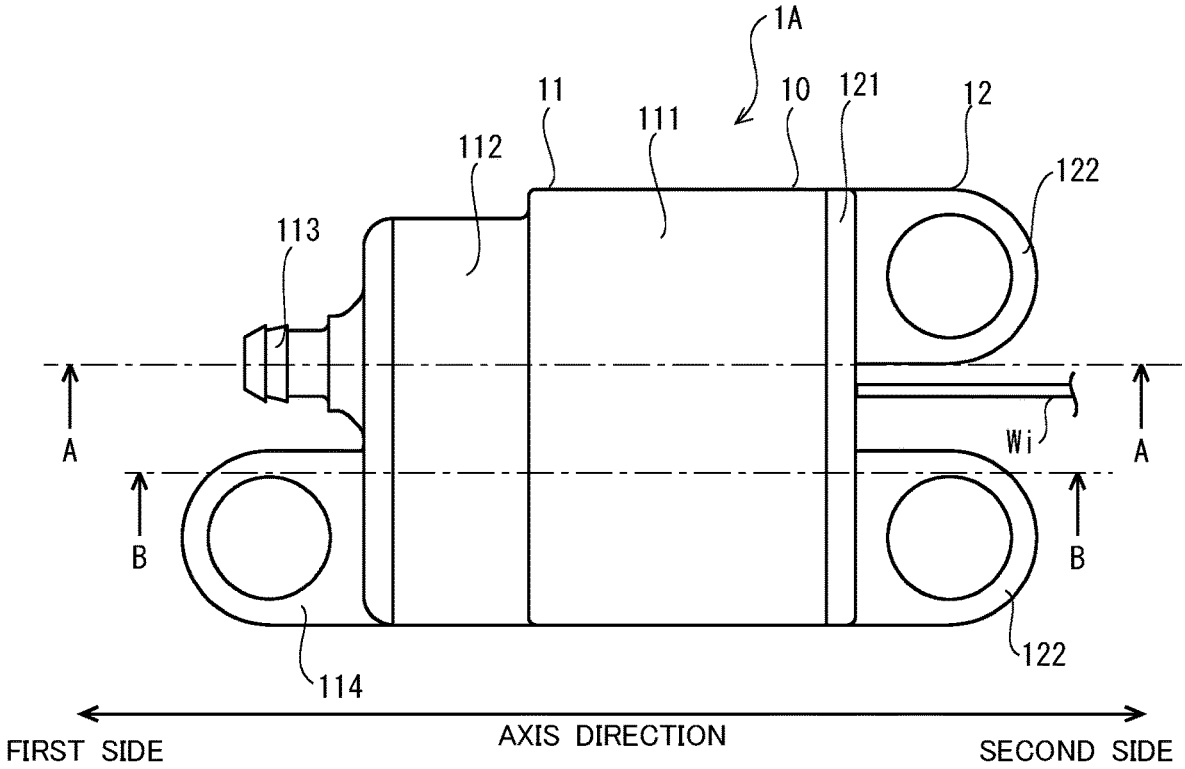
FIG. 4 is a plan view of the compressor illustrated in FIG. 2.

FIG. 4 is a plan view of the compressor 1A illustrated in FIG. 2. As illustrated in FIG. 4, the compressor 1A further includes a case 10 and a wire Wi. A configuration that holds the wire Wi is not illustrated in FIG. 4.

The case 10 houses the piston 20 and the drive 30. The wire Wi connects the controller 1D with the drive 30.

Figure 5:
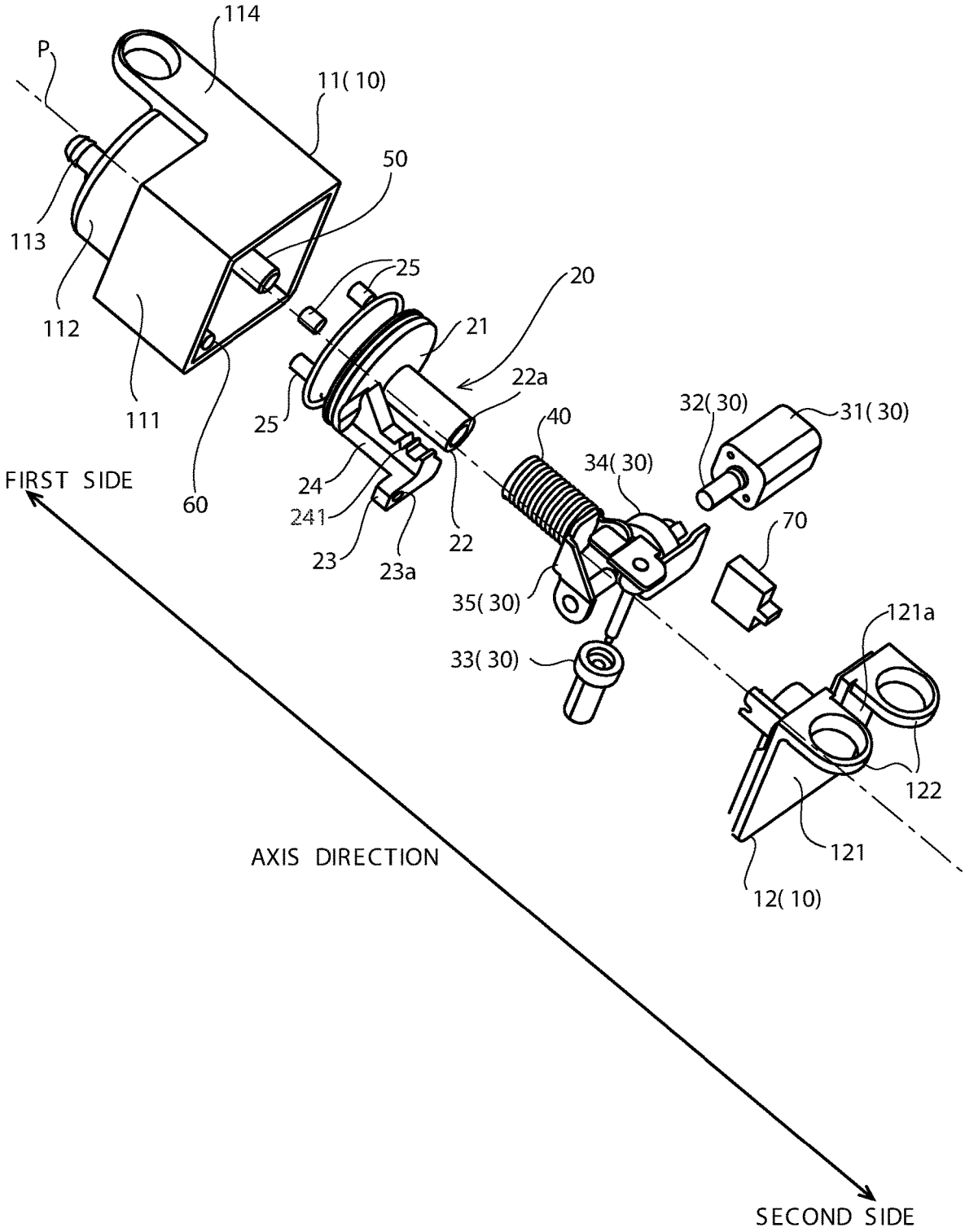
FIG. 5 is an exploded perspective view of the compressor illustrated in FIG. 2.

FIG. 5 is an exploded perspective view of the compressor 1A illustrated in FIG. 2. As illustrated in FIG. 5, the compressor 1A further includes a coil spring 40, a main shaft 50, a countershaft 60, and a switch 70. Details of the coil spring 40, the main shaft 50, the countershaft 60, and the switch 70 will be described later. The wire Wi is not illustrated in FIG. 5.

First, a central axis P of the compressor 1A will be defined. The central axis P is a linear line vertical to a compression board 21 of the piston 20, and goes through a center of the compression board 21. In the description below, a direction viewed from a lid 12 of the case 10 to the piston 20 is defined as a first side in an axis direction in which the central axis P extends. A direction viewed from the piston 20 to the lid 12 of the case 10 is defined as a second side" in the axis direction in which the central axis P extends. The first side and the second side are opposite to each other.

The case 10 houses the coil spring 40, the main shaft 50, the countershaft 60, and the switch 70 in addition to the piston 20 and the drive 30. The case 10 includes a body 11 and the lid 12.

The body 11 is hollowed and extends in the axis direction. The body 11 is configured to be an end portion of the case 10 in the axis direction on the first side. An end portion of the body 11 is closed in the axis direction on the first side, and an end portion of the body 11 is open in the axis direction on the second side.

The lid 12 is fitted into the end portion of the body 11 in the axis direction on the second side. The lid 12 is configured to be an end portion of the case 10 in the axis direction on the second side.

The piston 20 moves back and forth in the axis direction inside the case 10. When the piston 20 moves in the axis direction toward the first side, air inside the case 10 is compressed, and thus the compressed air is generated.

The drive 30 is arranged between the lid 12 and the compression board 21 of the piston 20. The drive 30 drives the piston 20 to move along the axis direction. More specifically, the drive 30 moves the piston 20 in the axis direction toward the second side.

The coil spring 40 is inserted into a main shaft bush 22 of the piston 20, and applies a force to the piston 20 to move in the axis direction toward the first side.

The main shaft 50 is cylindrically shaped and extends in the axis direction inside the case 10. The main shaft 50 guides the piston 20 to move along the axis direction. The main shaft 50 is held by the case 10. A central axis of the main shaft 50 does not go through the center of the compression board 21.

The countershaft 60 is cylindrically shaped that extends in the axis direction inside the case 10. The countershaft 60 guides the piston 20 to move along the axis direction. The countershaft 60 is arranged so as to be in a position different from a position of the main shaft 50 as viewed in the axis direction. An end portion of the countershaft 60 is held by the case 10.

The switch 70 is, for example, fixed on an inner circumference surface of the case 10. The switch 70 is provided to an end portion of a compressing portion 112 in the axis direction on the second side. When the switch 70 contacts the compression board 21, the switch 70 is On. When the switch 70 does not contact the compression board 21, the switch 70 is Off. The switch 70 supplies, to the controller 1D via the wire Wi, a detection signal indicating that the switch 70 is On or Off. Details of the switch 70 will be described later. The switch 70 is used to stop the piston 20 in an initial position of the piston 20.

2.2. Configuration of the Case 10

(Body 11)

As illustrated in FIG. 5, the body 11 includes a housing 111, the compressing portion 112, an outlet 113, and an installation portion 114. The housing 111, the compressing portion 112, the outlet 113, and the installation portion 114 are made of resin or the like, and are formed as one unit.

Figure 6:
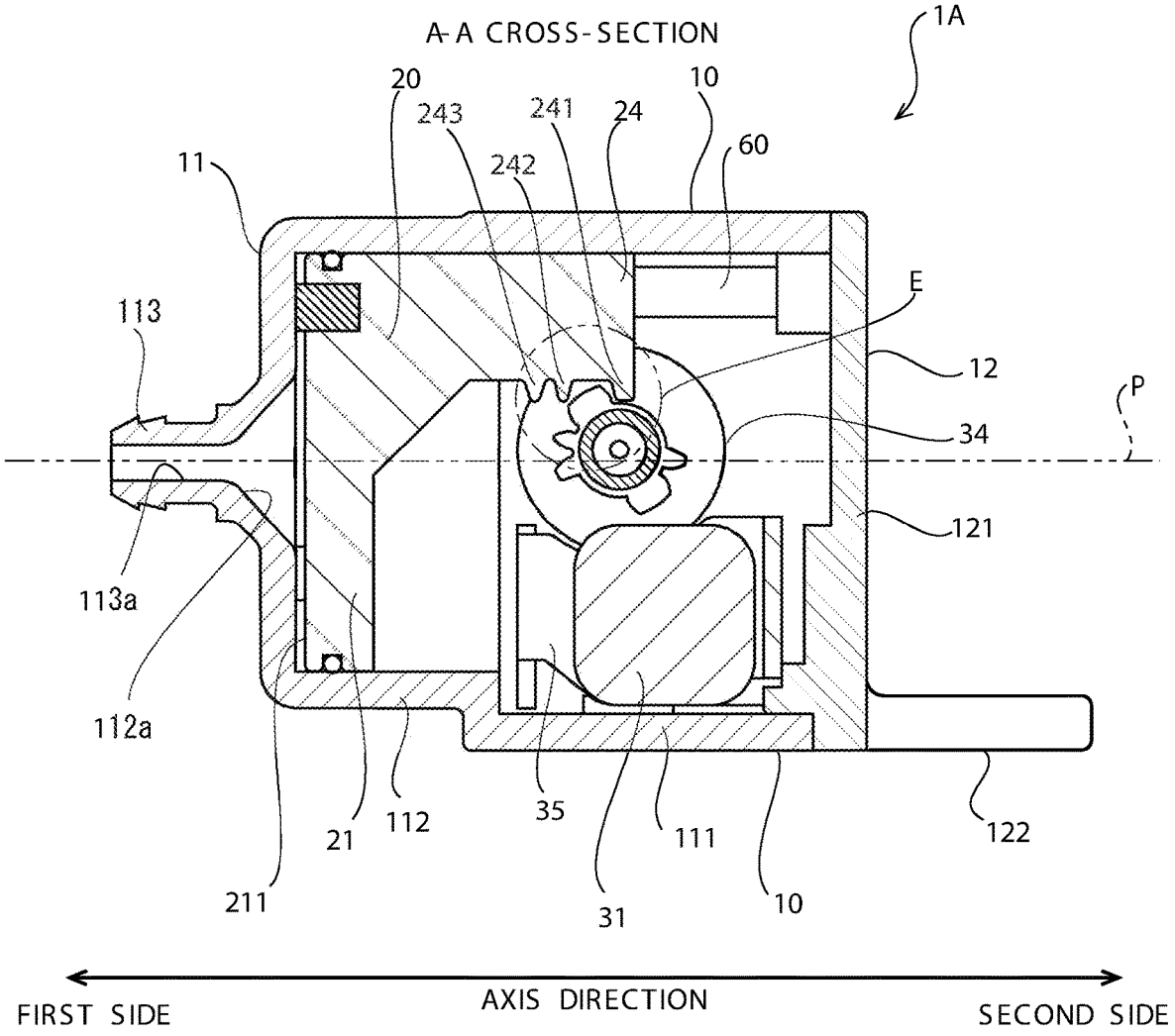
FIG. 6 is a cross-section of the compressor along the line A-A illustrated in FIG. 4.
Figure 7:
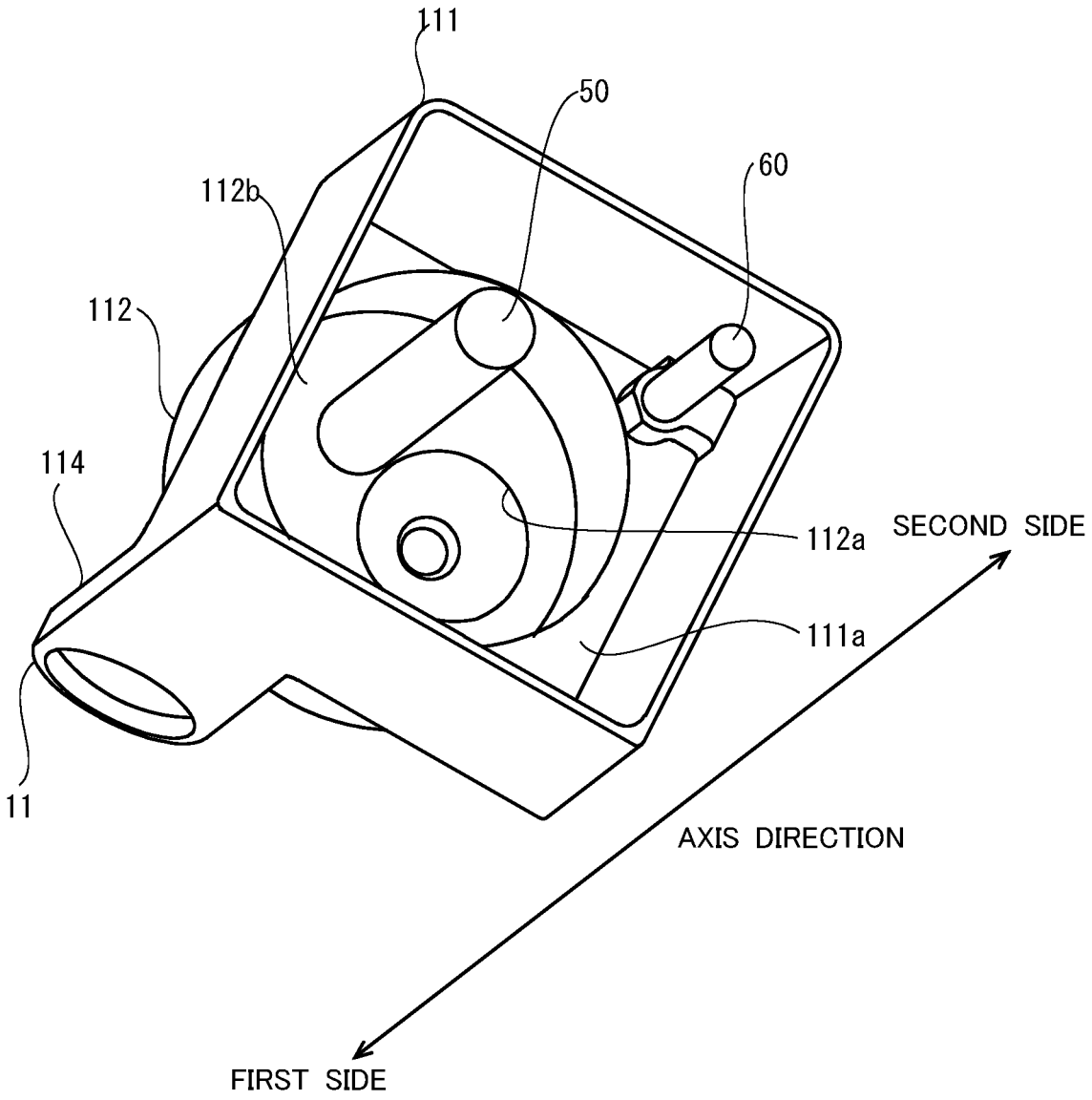
FIG. 7 is a perspective view of a body illustrated in FIG. 6 as viewed from a lid.

FIG. 6 is a cross-section of the compressor 1A along the line A-A illustrated in FIG. 4. FIG. 7 is a perspective view of the body 11 illustrated in FIG. 6 as viewed from the lid 12. As illustrated in FIG. 6, the housing 111 is hollowed and extends in the axis direction. A cross-section of the housing 111 is rectangular. End portions of the housing 111 are open on both sides in the axis direction. The housing 111 houses the drive 30 and a portion of the piston 20. The housing 111 is the end portion of the body 11 in the axis direction on the second side.

The compressing portion 112 is hollowed and extends in the axis direction. A cross-section of the compressing portion 112 is circular. The compressing portion 112 is arranged in the axis direction on the first side further than the housing 111, and on the second side further than the outlet 113 and the installation portion 114 in the axis direction. An end portion of the compressing portion 112 is open in the axis direction on the second side. An end portion of the compressing portion 112 is closed in the axis direction on the first side. An inner space of the compressing portion 112 is connected to an inner space of the housing 111. A through hole 112*a* runs through the end portion in the axis direction on the first side of the compressing portion 112. When the piston 20 moves in the axis direction toward the first side, the compressed air is generated inside the compressing portion 112. The compressed air moves out of the compressor 1A via the through hole 112*a*.

As illustrated in FIG. 7, a cross-section area of an inner space of the housing 111 is greater than a cross-section area of the inner space of the compressing portion 112. The cross-section area of the inner space is here defined as an area of a region vertical to the axis direction in the inner space of each of the housing 111 and the compressing portion 112. Therefore, the housing 111 has an inner end surface 111*a* vertical to the axis direction, on the end portion in the axis direction on the first side.

As illustrated in FIG. 6, the outlet 113 is hollowed and extends in the axis direction. A cross-section of the outlet 113 is circular. The outlet 113 is arranged on the first side further than the compressing portion 112 in the axis direction. An inner diameter of the outlet 113 is smaller than an inner diameter of the compressing portion 112. The end portions of the outlet 113 are open on the both sides. A through hole 113*a* runs through the outlet 113 in the axis direction. The through hole 113*a* is connected to the through hole 112*a* of the compressing portion 112. Therefore, the compressed air is released to an outside of the compressor 1A from the through hole 112*a* via the outlet 113.

As illustrated in FIG. 5, the installation portion 114 protrudes from the end portion of the housing 111 in the axis direction on the first side, in the axis direction toward the first side. The installation portion 114 is used to fix the compressor 1A to the rear panel 2*b* of the vehicle 2.

(Lid 12)

As illustrated in FIG. 6, the lid 12 includes a side board 121 and an installation portion 122. The side board 121 and the installation portion 122 are made of resin or the like, and are formed as one unit.

The side board 121 is vertical to the axis direction, and is located in the axis direction on the first side further than the installation portion 122. The side board 121 closes the end portion of the housing 111 in the axis direction on the second side. As illustrated in FIG. 5, a cutout 121*a* is provided to the side board 121. The wire Wi is guided from an outside of the case 10 to an inside of the case 10 via the cutout 121*a*.

A sealing member, not illustrated, may be provided between the housing 111 and the side board 121, to prevent the air from leaking from the case 10. The packing for wiring may close the cutout 121*a* while holding the wire Wi.

2.3. Configuration of the Piston 20

As illustrated in FIG. 5, the piston 20 includes the compression board 21, the main shaft bush 22, a countershaft bush 23, and a rack 24. The compression board 21, the main shaft bush 22, the countershaft bush 23, and the rack 24 are made of resin or the like, and are formed as one unit.

Figure 8:
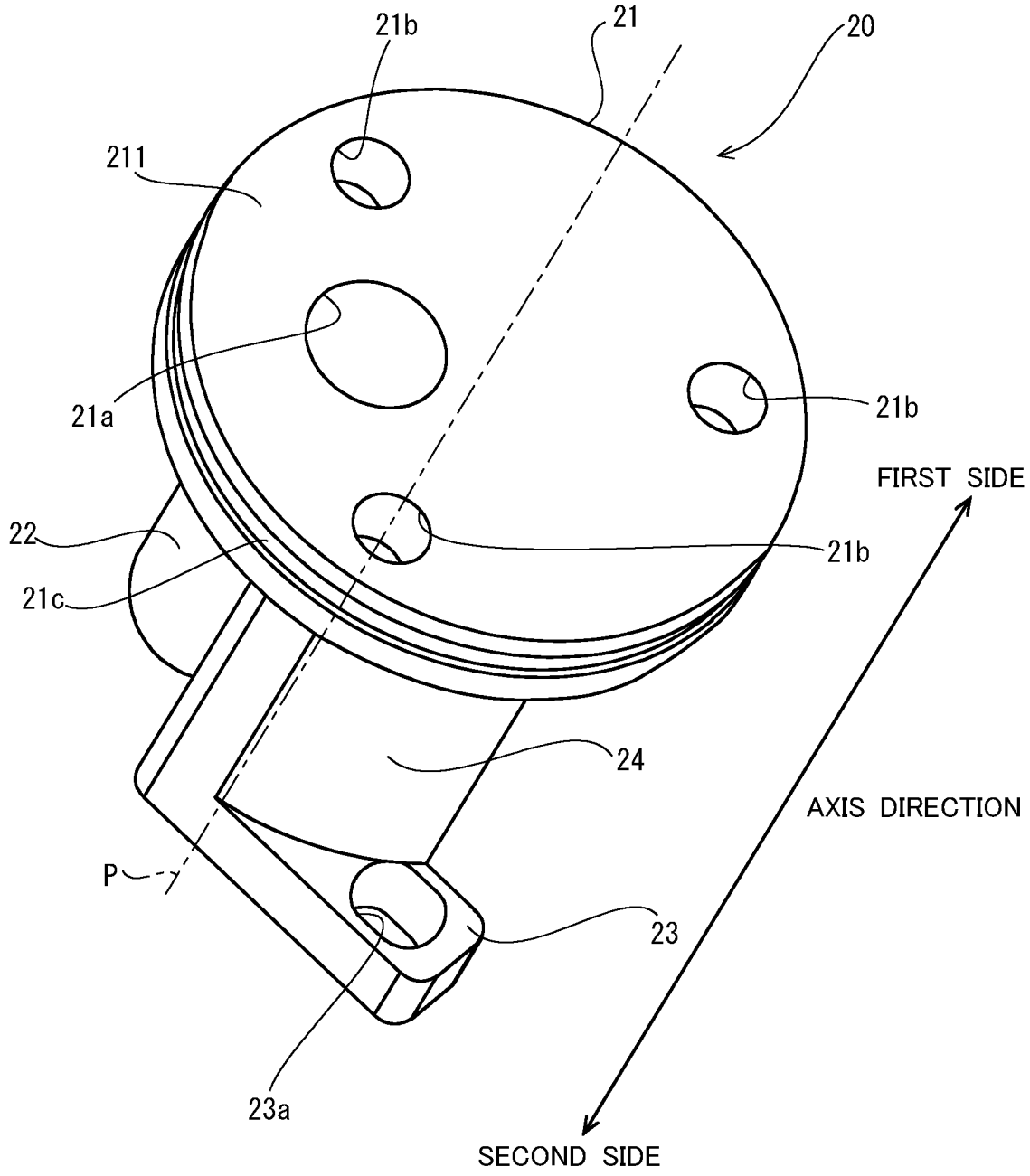
FIG. 8 is a perspective view of a piston as viewed from an outlet illustrated in FIG. 5.
Figure 9:
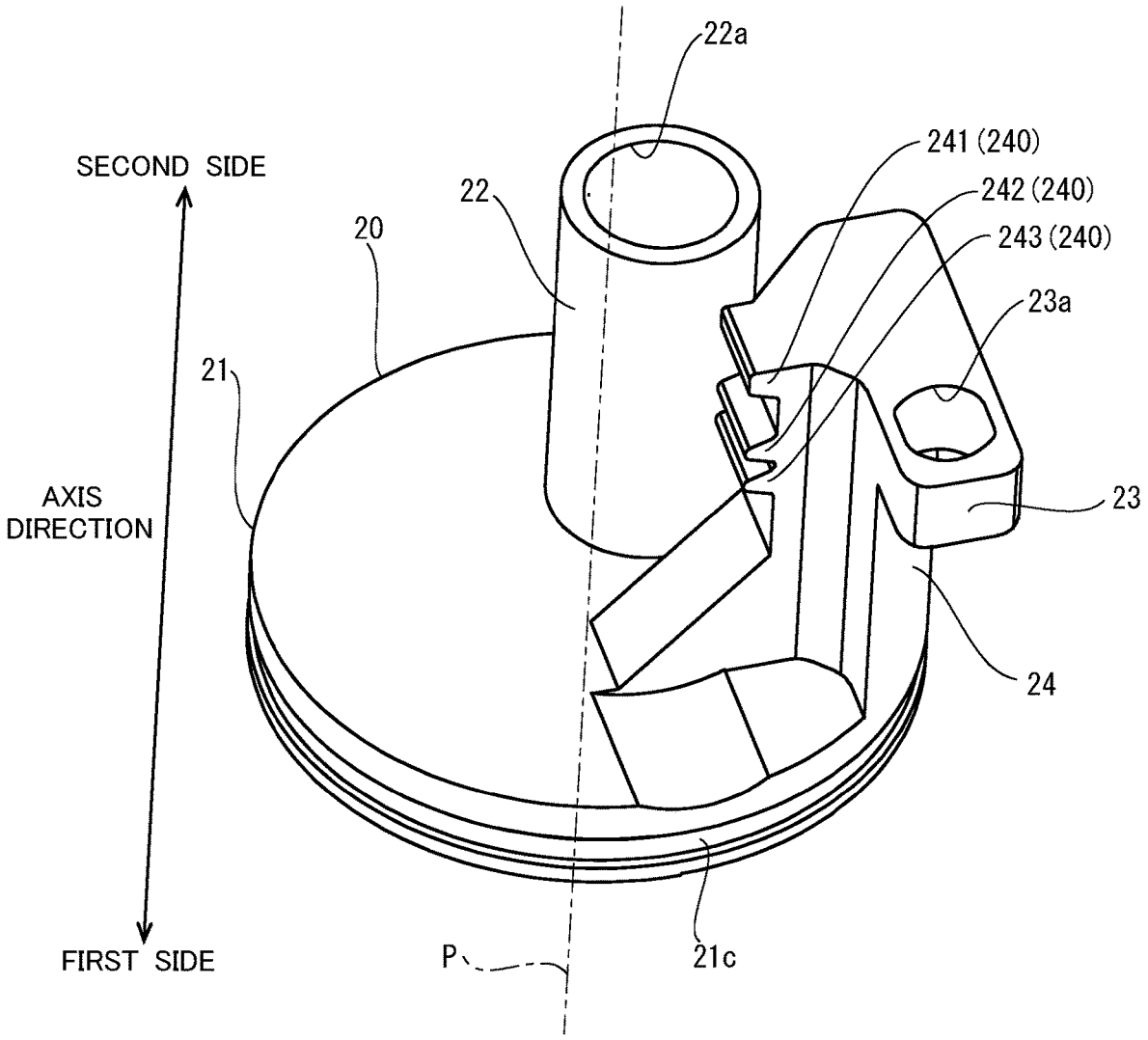
FIG. 9 is a perspective view of the piston as viewed from the lid illustrated in FIG. 5.
Figure 10:
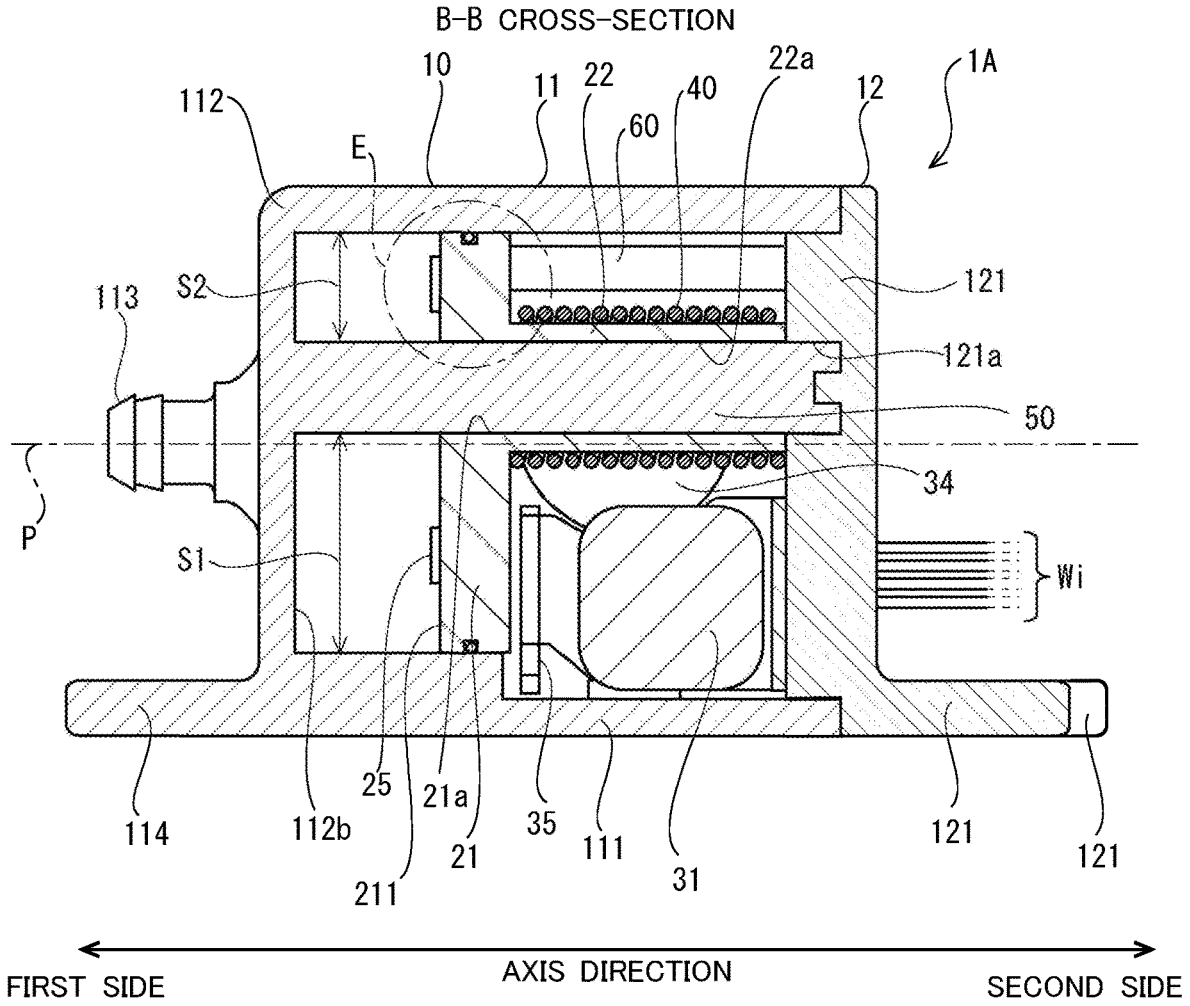
FIG. 10 is a cross-section of the compressor along the line B-B illustrated in FIG. 4.

FIG. 8 is a perspective view of the piston 20 as viewed from the outlet 113 illustrated in FIG. 5. FIG. 9 is a perspective view of the piston 20 as viewed from the lid 12 illustrated in FIG. 5. FIG. 10 is a cross-section of the compressor 1A along the line B-B illustrated in FIG. 4.

(Compression Board 21)

As illustrated in FIG. 8, the compression board 21 is disc shaped, and is arranged so as to be vertical to the central axis P. The compression board 21 is the end portion of the piston 20 in the axis direction on the first side. A diameter of the compression board 21 corresponds to the inner diameter of the compressing portion 112. The compression board 21 is placed inside the compressing portion 112. When the piston 20 moves in the axis direction toward the first side, air inside the compressing portion 112 is compressed by the compression board 21.

A through hole 21*a* runs through the compression board 21 in the axis direction. An inner circumference surface of the through hole 21*a* is cylindrical. When the compression board 21 is viewed in the axis direction, a position of the through hole 21*a* is away from the center of the compression board 21. In other words, a center of the through hole 21*a* does not match the central axis P.

A plurality of installation holes 21*b* are provided on a surface 211 on the first side, out of the end surfaces of the compression board 21 in the axis direction. An impact absorbing rubber 25 (see FIG. 5) is fitted into the plurality of installation holes 21*b*.

(Main Shaft Bush 22)

As illustrated in FIG. 9, the main shaft bush 22 is cylindrically shaped, and extends in the axis direction. In other words, a through hole 22*a* runs through the main shaft bush 22 in the axis direction. An inner circumference surface of the through hole 22*a* is cylindrically shaped. End portions of the main shaft bush 22 are open on the both sides. An outer diameter of the main shaft bush 22 is smaller than an outer diameter of the compression board 21. The outer diameter here is defined as a distance between a central axis of each configuration element and the outer circumferential surface. The central axis of each configuration element is parallel to the axis direction, and also runs through a gravity center of each configuration element.

The main shaft bush 22 is provided in the axis direction on the second side further than the compression board 21. The end portion of the main shaft bush 22 in the axis direction on the first side is connected to the compression board 21. Since an inner circumference surface of the main shaft bush 22 is continuous with the inner circumference surface of the through hole 21*a*, the through hole 21*a* of the compression board 21 and the through hole 22*a* of the main shaft bush 22 are formed as one continuous hole. An inner diameter of the through hole 21*a* matches to an inner diameter of the through hole 22*a*. Therefore, in a case where the piston 20 is viewed in the axis direction, the main shaft bush 22 is disposed to a position away from the center of the compression board 21.

(Countershaft Bush 23)

As illustrated in FIG. 9, the countershaft bush 23 is hollowed, and extends in the axis direction. The countershaft bush 23 is disposed in the axis direction on the second side of the piston 20. A through hole 23*a* runs through the countershaft bush 23 in the axis direction. End portions of the countershaft bush 23 are open on the both sides. When the piston 20 is viewed in the axis direction, the countershaft bush 23 is located outside the compression board 21. The countershaft bush 23 is connected to the compression board 21 by the rack 24. When the piston 20 is viewed in the axis direction, the center of the compression board 21 is located outside a zonal region between the main shaft bush 22 and the countershaft bush 23.

(Rack 24)

As illustrated in FIG. 9, the rack 24 extends in the axis direction. A plurality of rack teeth 240 are provided on a surface of the rack 24 that faces an inside of the compression board 21 in a diameter direction of the compression board 21. The inside in the diameter direction of the compression board 21 is a direction viewed from an outer circumference to the center axis P of the compression board 21. The rack teeth 240 are arranged in the axis direction. A direction that the rack teeth 240 face is perpendicular to the axis direction. When the rack 24 and a pinion 342 of a speed reducer 34 of the drive 30 are engaged with each other, the rack 24 and the pinion 342 function as a rack and pinion.

The rack 24 connects the countershaft bush 23 to the compression board 21. An end portion of the rack 24 in the axis direction on the first side is connected to the compression board 21. An end portion of the rack 24 in the axis direction on the second side is connected to the countershaft bush 23. The countershaft bush 23 protrudes from the end portion of the rack 24 in the axis direction on the second side to an outside of the compression board 21 in the diameter direction of the compression board 21. The diameter direction is perpendicular to the central axis P.

Figure 11:
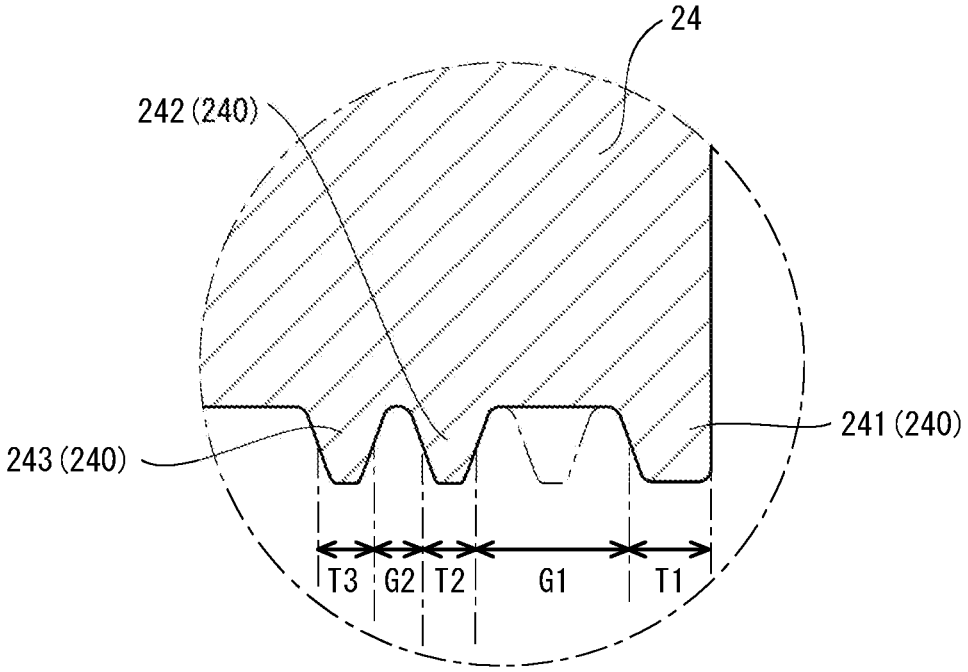
FIG. 11 is a partially enlarged view of a rack illustrated in FIG. 6.

FIG. 11 is a partially enlarged view of the rack 24 illustrated in FIG. 6. FIG. 11 corresponds to the enlarged view of the region E shown in FIG. 6. The speed reducer 34 is not illustrated in FIG. 11. As illustrated in FIG. 11, a rack tooth 241 is located in the axis direction on the second side furthest among the rack teeth 240. A rack tooth 242 is provided next to the rack tooth 241. A rack tooth 243 is provided next to the rack tooth 242, and is provided furthest in the axis direction on the first side among the rack teeth 240.

A shape of the rack tooth 242 is same as a shape of the rack tooth 243. A shape of the rack tooth 241 is different from the shapes of the rack teeth 242 and 243. More concretely, a tooth thickness T1 of the rack tooth 241 is greater than a tooth thickness T2 of the rack tooth 242 and a tooth thickness T3 of the rack tooth 243. Shapes of the rack teeth 242 and 243 are not limited to the shapes illustrated in FIG. 11. For example, a tooth curve of the rack tooth 242 may be different from a tooth curve of the rack tooth 243.

A width G1 of a space between the rack teeth 241 and 242 is greater than a width G2 of a space between the rack teeth 242 and 243. On an assumption that the rack 24 has a plurality of the rack teeth having a same pitch between the rack teeth, the width G1 of the space corresponds to a space between the rack tooth first from the second side in the axis direction and the rack tooth third from the second side in the axis direction. Among the rack teeth formed on the assumption, a rack tooth second from the second side in the axis direction is eliminated. The rack tooth eliminated is shown in a two-dot chain line in FIG. 11.

2.4. Arrangement and Configuration of the Drive 30

As illustrated in FIG. 10, when the piston 20 most approaches the side board 121 (the end portion of the case 10 in the axis direction on the second side), a space surrounded by the compression board 21, the main shaft bush 22 and the side board 121 is formed. The drive 30 is placed in the space surrounded by the compression board 21, the main shaft bush 22 and the side board 121. Thus, the compressor 1A can be downsized.

As illustrated in FIG. 5, the drive 30 includes a motor 31, an inclined tooth gear 32, a speed reducer 33, the speed reducer 34, and a holder 35. Illustration of the teeth of the inclined tooth gear 32, the speed reducers 33 and the speed reducer 34 is omitted in FIG. 5.

The motor 31 is connected to the controller 1D via the wire Wi. The motor 31 supplies a force to the piston 20 to move in the axis direction toward the second side, according to the control signal from the controller 1D.

The inclined tooth gear 32 rotates, being coupled with a rotation axis of the motor 31. The speed reducer 33 is a two stepped gear including a large gear 331 and a small gear 332. A diameter of the large gear 331 is greater than a diameter of the small gear 332. The large gear 331 and the small gear 332 are coaxially arranged, and are fixed to each other.

Figure 12:
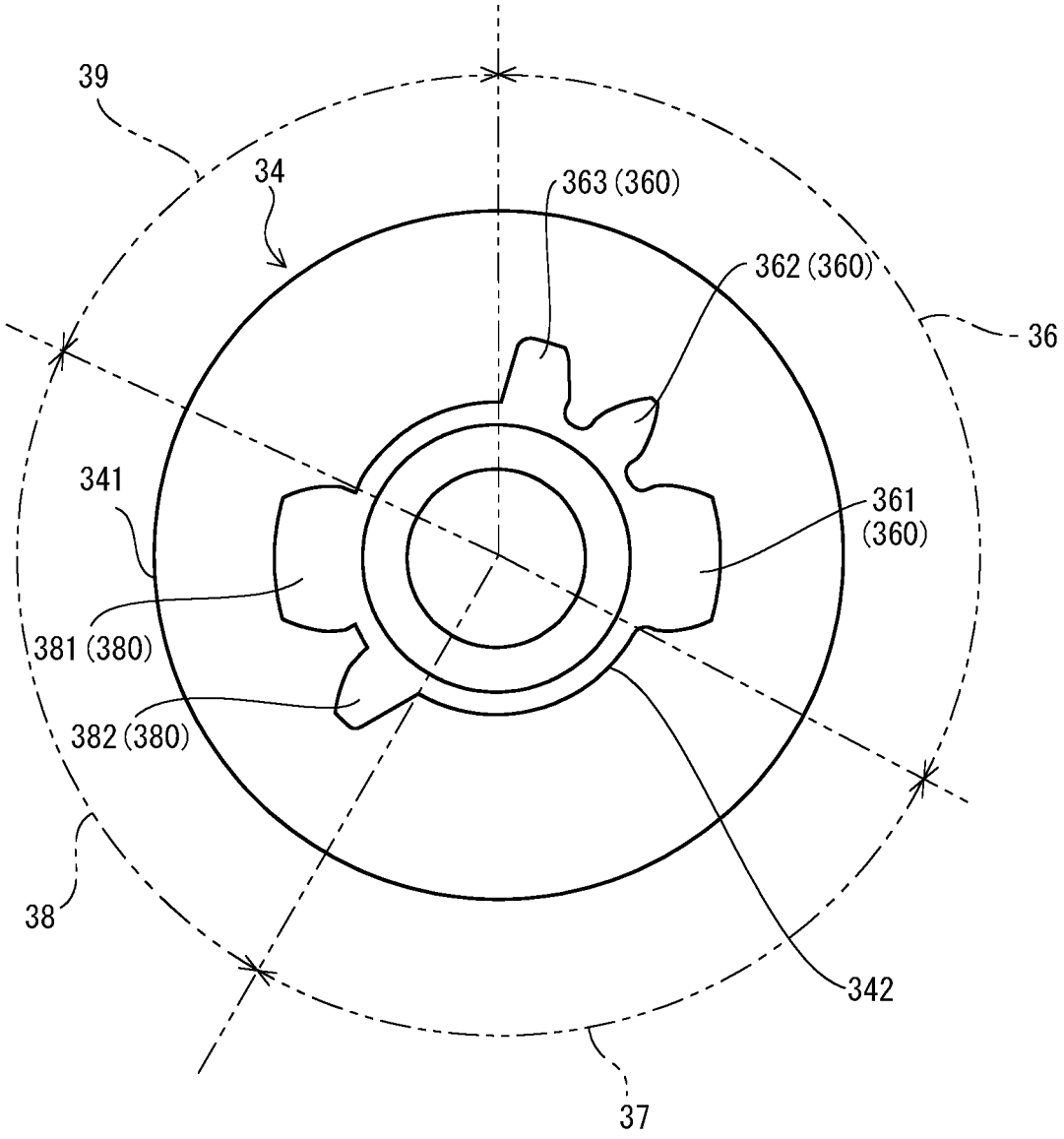
FIG. 12 is a plan view of a speed reducer illustrated in FIG. 5.

FIG. 12 is a plan view of the speed reducer 34. As illustrated FIG. 12, the speed reducer 34 includes a large gear 341 and the pinion 342. In FIG. 12, a tooth formed on the large gear 341 is not illustrated. A diameter of the large gear 341 is greater than a diameter of the pinion 342. The large gear 341 and the pinion 342 are coaxially arranged, and are fixed to each other. Details of the pinion 342 will be described later.

The inclined tooth gear 32 is engaged with the large gear 331 of the speed reducer 33. The small gear 332 of the speed reducer 33 is engaged with the large gear 341 of the speed reducer 34. The pinion 342 of the speed reducer 34 is engaged with the rack 24 of the piston 20. Thus, a torque of the motor 31 is converted into the force that moves the piston 20 in the axis direction toward the second side.

The holder 35 is fixed inside the housing 111, and holds the motor 31. Moreover, the holder 35 rotatably holds the speed reducer 33 and the speed reducer 34.

2.5. Configuration of the Pinion 342

As illustrated in FIG. 12, the pinion 342 includes toothed regions 36 and 38, and flat regions 37 and 39. The toothed region 36 includes a plurality of pinion teeth 360. The plurality of pinion teeth 360 includes a leading tooth 361, a middle tooth 362, and an end tooth 363. The toothed region 38 includes a plurality of pinion teeth 380. The plurality of pinion teeth 380 includes a leading tooth 381 and an end tooth 382. A number of the pinion teeth 360 formed on the toothed region 36 is greater than a number of the pinion teeth 380 formed on the toothed region 38. The number of the pinion teeth 360 formed on the toothed region 36 should be different from the number of the pinion teeth 380 formed on the toothed region 38.

No pinion tooth is formed on the flat regions 37 and 39. The flat regions 37 and 39 are adjacent to the toothed region 36 in a circumferential direction, and also adjacent to the toothed region 38 in the circumferential direction. The toothed region and the flat region are arranged alternately in the circumferential direction. In other words, the pinion 342 is an intermittent gear that has the untoothed flat regions formed at intervals in the circumferential direction.

The speed reducer 34 illustrated in FIG. 12 rotates clockwise. In a case where the piston 20 is moved in the axis direction to the second side, the controller 1D drives the motor 31 to rotate the speed reducer 34 clockwise.

Figure 13:
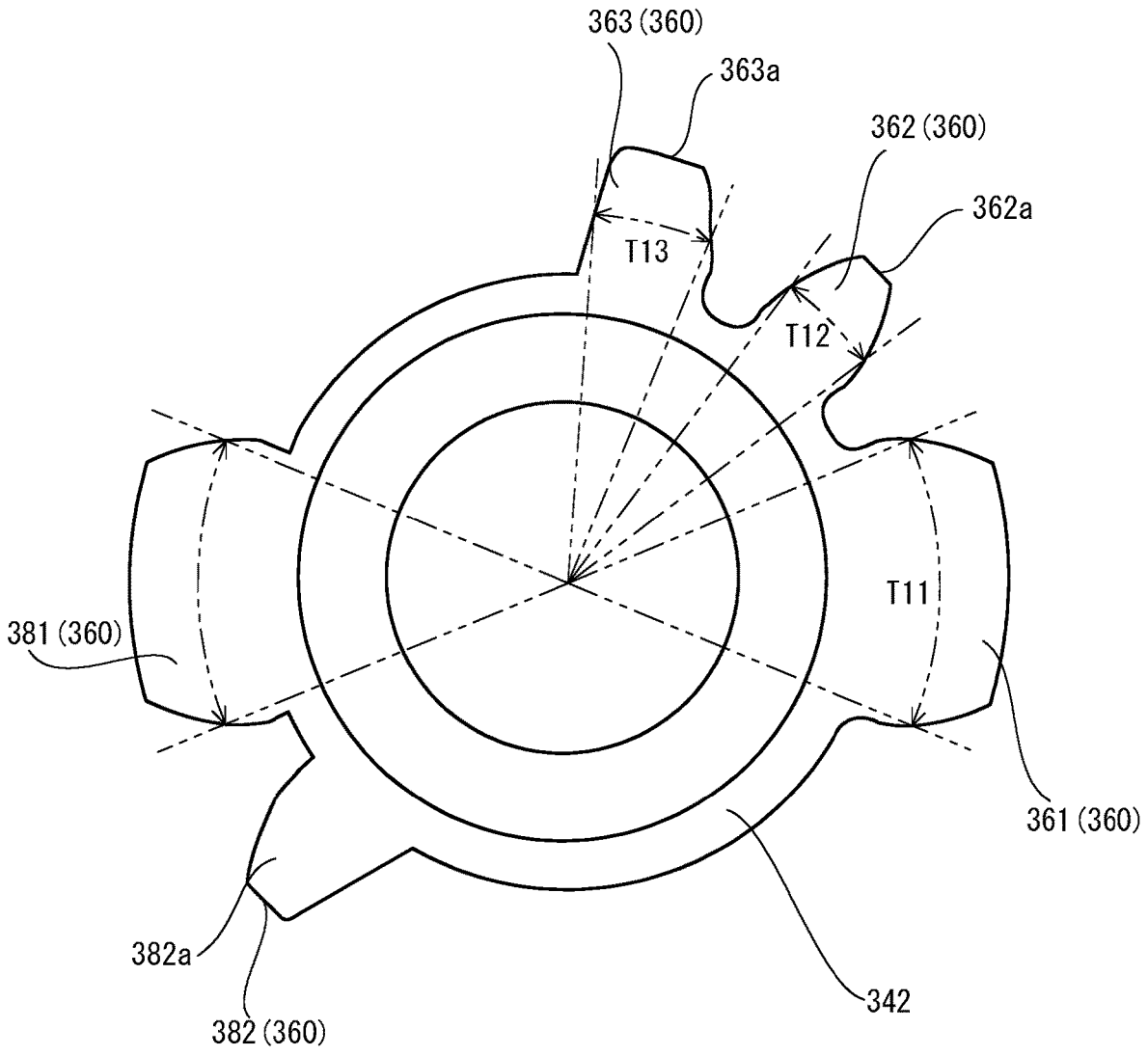
FIG. 13 illustrates a relationship among teeth that are formed on a pinion illustrated in FIG. 6.

FIG. 13 illustrates a relationship among the teeth formed on the pinion 342. As illustrated in FIG. 13, a tooth thickness T11 of the leading tooth 361 is greater than a tooth thickness T12 of the middle tooth 362 and a tooth thickness T13 of the end tooth 363. If the middle teeth 362 of the pinion 342 are equally spaced, a tooth thickness of the leading tooth 361 is substantially equal to a sum of a width of a space between two middle teeth 362 arranged next to each other in the circumferential direction and tooth thicknesses of the two middle teeth.

When the piston 20 stops at the initial position thereof, the end tooth 363 touches the rack tooth 243. A size of a tooth tip 363*a* of the end tooth 363 in the circumferential direction is greater than a size of a tooth tip 362*a* of the middle tooth 362 in the circumferential direction. The circumferential direction here is a rotation direction of the pinion 342. The end tooth 363 is a movement prevention tooth that prevents the piston 20 from moving in the axis direction when the compressor 1A is on standby for generating the compressed air. Details of the move prevention of the piston 20 will be described later.

The leading tooth 381 of the pinion teeth 380 has a tooth thickness T21 that is a same thickness as a tooth thickness T11 of the leading tooth 361 on the toothed region 36. A size of a tooth tip 382*a* of the end tooth 382 in the circumferential direction is equal to or greater than the tooth tip 363*a* in the circumferential direction.

2.6. Arrangement of the Coil Spring 40

As illustrated in FIG. 10, the coil spring 40 is arranged inside the case 10 so as to extend in the axis direction. The main shaft bush 22 is inserted into the coil spring 40. An end portion of the coil spring 40 in the axis direction on the first side touches a surface of the compression board 21 in the axis direction on the second side. An end portion of the coil spring 40 in the axis direction on the second side touches the lid 12. Thus, the coil spring 40 applies the force to the piston 20 to move in the axis direction toward the first side of the case 10.

2.7. Arrangement of the Main Shaft 50

As illustrated in FIG. 7, the main shaft 50 is arranged inside the case 10. More specifically, the main shaft 50 is arranged inside the housing 111 and the compressing portion 112.

As illustrated in FIG. 10, the end portion of the main shaft 50 in the axis direction on the first side is connected to an inner end surface 112*b* of the end portion of the compressing portion 112 in the axis direction on the first side. The main shaft 50 is formed with the body 11 as one unit. In other words, the end portion of the compressing portion 112 in the axis direction on the first side holds the end portion of the main shaft 50 in the axis direction on the first side.

The end portion of the main shaft 50 in the axis direction on the second side is held by the side board 121 of the lid 12. More specifically, the cutout 121*a* is formed on a surface of the side board 121 in the axis direction on the first side. The cutout 121*a* is open, facing the first side in the axis direction. The end portion of the main shaft 50 in the axis direction on the second side is fitted into the cutout 121*a*. Thus, the end portion of the main shaft 50 in the axis direction on the second side is held by the side board 121. At least one of the end portions of the main shaft 50 may be held by the case 10.

The main shaft 50 is inserted into the through hole 21*a* of the compression board 21 and the through hole 22*a* of the main shaft bush 22. A length of the main shaft 50 in the axis direction is greater than a length of the piston 20 in the axis direction. Thus, the main shaft 50 guides the piston 20 to move along the axis direction.

2.8. Arrangement of the Countershaft 60

As illustrated in FIG. 7, the countershaft 60 is arranged inside the case 10. More specifically, the countershaft 60 is placed inside the housing 111. The countershaft 60 is inserted into the through hole 23*a* that is formed on the countershaft bush 23 of the piston 20. Therefore, the countershaft 60 is arranged so as to be in the position different from the position of the main shaft 50 as viewed in the axis direction.

An end portion of the countershaft 60 in the axis direction on the first side is connected to the inner end surface 111*a* of the housing 111. The countershaft 60 is formed with the body 11 as one unit. Thus, the end portion of the housing 111 in the axis direction on the first side holds the end portion of the countershaft 60 on the one direction in the axis direction.

An end portion of the countershaft 60 in the axis direction on the second side is held by the side board 121. More specifically, a concave, not illustrated, is formed on a surface of the side board 121 in the axis direction on the first side. The end portion of the countershaft 60 in the axis direction on the second side is fitted into the concave that is not illustrated. Thus, the end portion of the countershaft 60 in the axis direction on the second side is held by the side board 121 of the lid 12. At least one of the end portions of the countershaft 60 may be held by the case 10.

The countershaft 60 goes through the countershaft bush 23 that is connected to the end portion of the rack 24 of the piston 20 in the axis direction on the second side. Thus, when the piston 20 moves along the axis direction, the countershaft 60 guides the piston 20 in the axis direction.

3. Motion of the Compressor 1A (Initial Position of the Piston 20)

Figure 14:
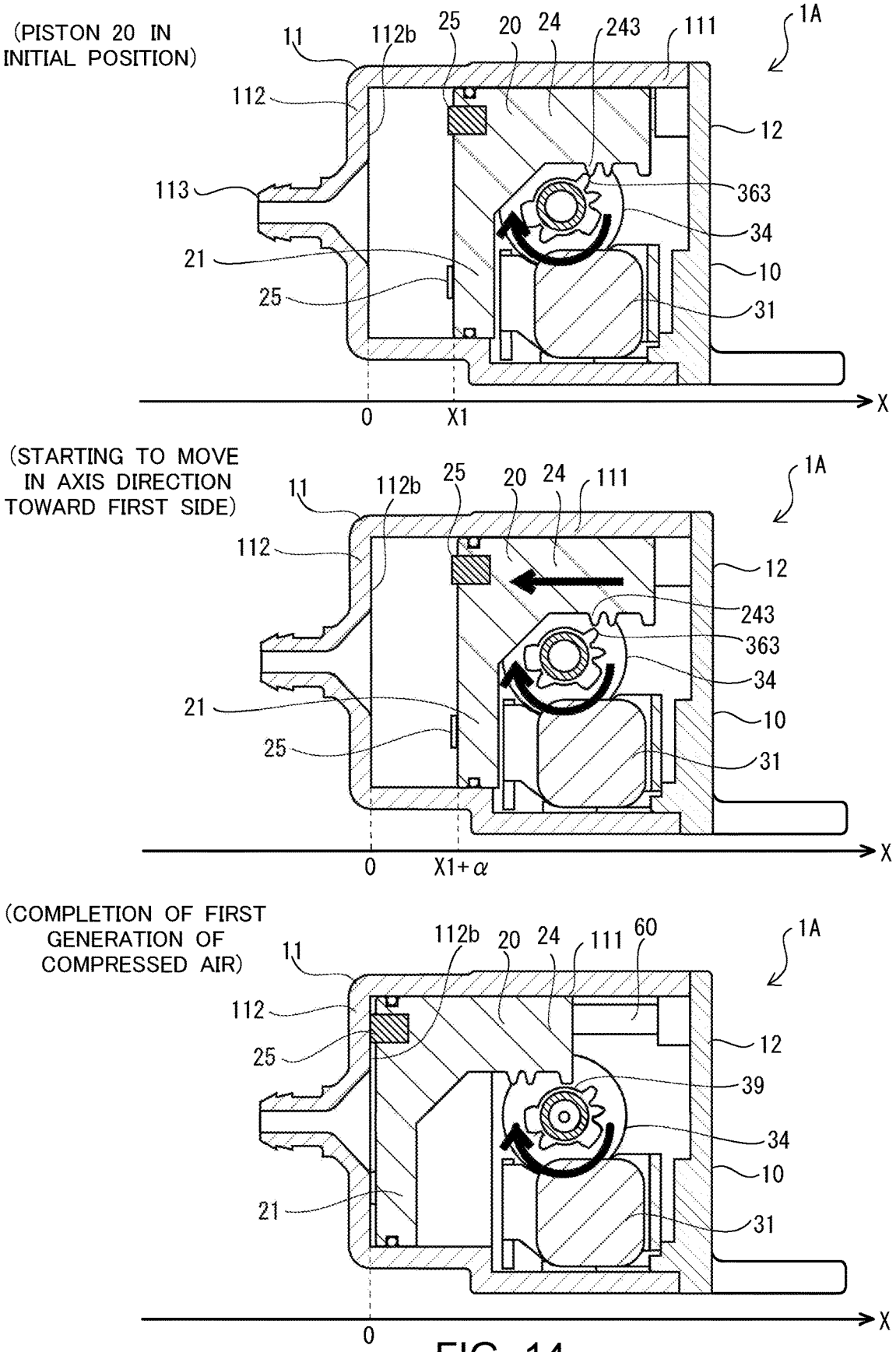
FIG. 14 illustrates movement of the piston illustrated in FIG. 5 in a first generation of compressed air.

FIG. 14 illustrates movement of the piston 20 in a first generation of the compressed air. An upper drawing of FIG. 14 illustrates the initial position of the piston 20. A middle drawing of FIG. 14 illustrates a position of the piston 20 when the piston 20 starts to move in the axis direction toward the first side in the first generation of the compressed air. A lower drawing of FIG. 14 illustrates a position of the piston 20 when the first generation of the compressed air is completed.

In a case where the attached object removal apparatus 1 does not eject the compressed air toward the lens of the camera 3, the compressor 1A is in a standby state. In the standby state, the controller 1D does not cause the motor 31 to rotate. As shown in the upper drawing in FIG. 14, the piston 20 does not move in the initial position in the standby state. In the initial position, the end tooth 363 of the pinion 342 touches the rack tooth 243 of the rack 24. More specifically, the tooth tip 363*a* of the end tooth 363 touches the rack tooth 243. In this case, the coil spring 40 applies the force to the piston 20 to move in the axis direction toward the first side. However, the piston 20 stays in a stop state because the force that the coil spring 40 applies the piston 20 is offset by a load force and the like of the motor 31.

Here, an X-axis that is parallel to the axis direction is defined. An origin point of the X-axis is a position of the inner end surface 112*b* of the compressing portion 112. A direction in the axis direction toward the second side is positive. A position of the piston 20 is specified by use of the surface 211 of the compression board 21 in the axis direction on the first side. In this case, the initial position of the piston 20 is X1.

(First Generation of the Compressed Air)

When the attached object removal apparatus 1 ejects the compressed air toward the lens of the camera 3, the controller 1D controls the motor 31 to work. The pinion 342 starts a clockwise rotary motion. Since the end tooth 363 is contacting the rack tooth 243, the rack 24 moves by a slight distance a in the axis direction toward the second side. After that, as illustrated in the middle drawing in FIG. 14, contact of the end tooth 363 of the pinion 342 with the rack tooth 243 is released. Thus, the force to move the piston 20 in the axis direction toward the second side does not work on the piston 20, and the piston 20 vigorously moves in the axis direction toward the first side by the force applied by the coil spring 40. The first compressed air is generated by compressing the air from the position X1 to the origin point. The generated compressed air is released to the outside of the compressor 1A from the outlet 113. Since a position in which the end tooth 363 of the pinion 342 contacts the rack tooth 243 is set as the initial position of the piston 20, it is possible to generate the compressed air immediately.

When the compressed air is generated, the compression board 21 collides with the inner end surface 112*b*. The impact absorbing rubber 25 is provided to the surface 211 of the compression board 21 in the axis direction on the first side. Therefore, impact sound that is generated when the compression board 21 collides can be reduced.

As illustrated in the lower drawing in FIG. 14, after the compressed air is generated, the compression board 21 contacts the inner end surface 112*b*. In this case, the position of the piston 20 is "0" (zero). Actually, since the impact absorbing rubber 25 projects from the surface 211 of the compression board 21 in the axis direction on the first side, the compression board 21 does not directly contact the inner end surface 112*b*. However, for convenience of explanation, when the position of the piston 20 is explained, a projection of the impact absorbing rubber 25 is disregarded.

In a time period for the first generation of the compressed air, the pinion 342 continues the rotary motion. In this time period, the flat region 39 of the pinion 342 (see FIG. 12) faces the rack 24. Therefore, the piston 20 moves in the axis direction toward the first side without contact with the pinion 342.

(Second Generation of the Compressed Air)

Figure 15:
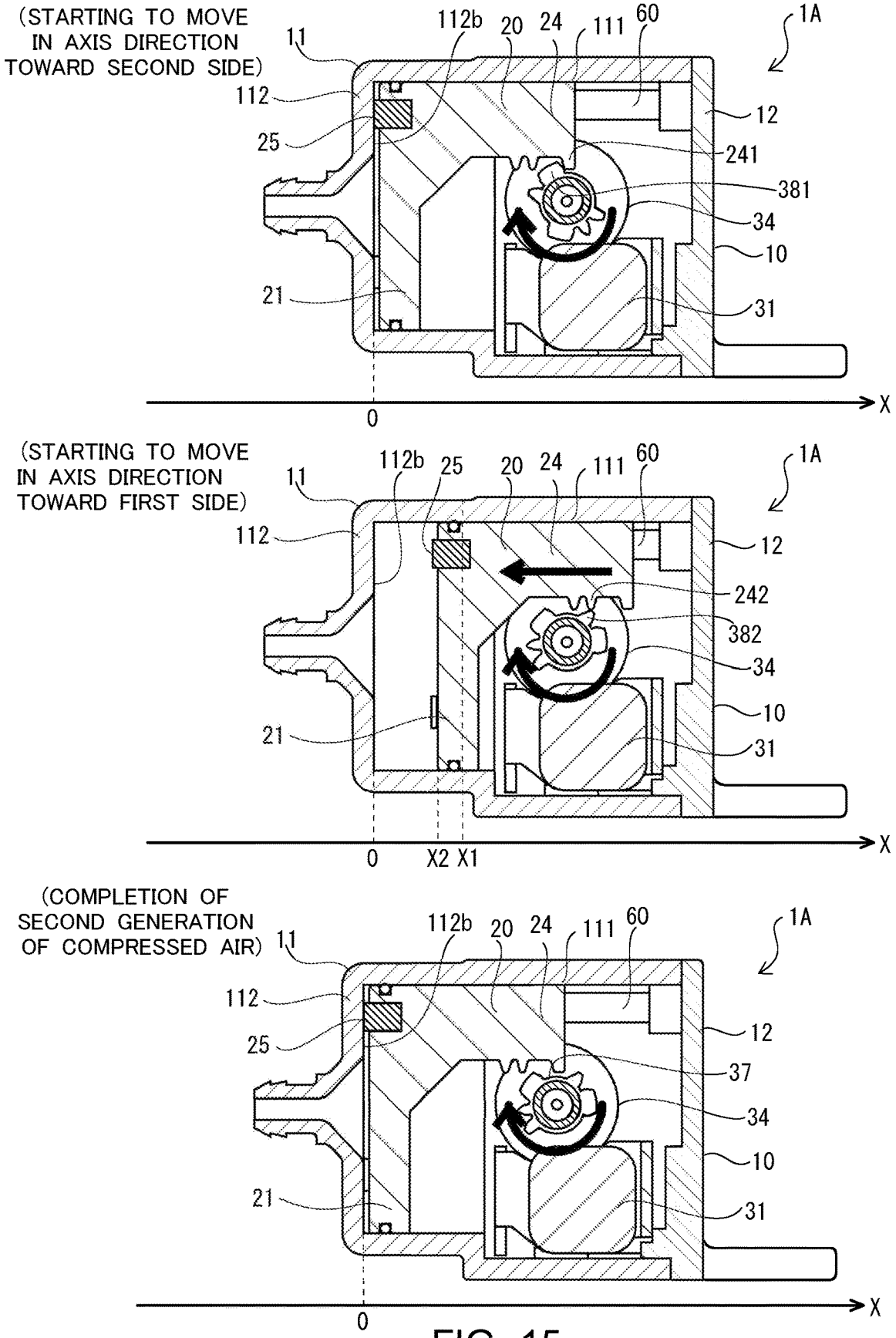
FIG. 15 illustrates movement of the piston illustrated in FIG. 5 in a second generation of the compressed air.

FIG. 15 illustrates movement of the piston 20 in a second generation of the compressed air. An upper drawing of FIG. 15 illustrates a position of the piston 20 when the piston 20 starts to move in the axis direction toward the second side for the second generation of the compressed air. A middle drawing of FIG. 15 illustrates a position of the piston 20 when the piston 20 starts to move in the axis direction toward the first side in the second generation of the compressed air. A lower drawing of FIG. 15 illustrates a position of the piston 20 when the second generation of the compressed air is completed.

After the first generation of the compressed air is completed, the controller 1D drives the motor 31 to work continuously. A rotation direction of the motor 31 is not changed. Therefore, the pinion 342 continues the clockwise rotary motion. Amongst from the pinion teeth 380 formed on the toothed region 38 of the pinion 342, the leading tooth 381 first contacts the rack 24. More specifically, the leading tooth 381 contacts the rack tooth 241, and then the end tooth 382 contacts the rack tooth 242. Thus, the piston 20 moves in the axis direction toward the second side.

The contact of the end tooth 382 with the rack tooth 242 is released by the continuous rotary motion of the pinion 342. Since, as viewed from the toothed region 38, the flat region 37 is counterclockwise adjacent to the toothed region 38, the piston 20 starts to move in the axis direction toward the first side. As illustrated in the middle drawing in FIG. 15, a position X2 is a position of the piston 20 when the contact of the end tooth 382 with the rack tooth 242 is released. A distance from the position X2 to the origin point is smaller than a distance from the position X1 to the origin point.

Once the contact of the end tooth 382 of the pinion 342 with the rack tooth 242 is released, the piston 20 vigorously moves in the axis direction from the position X2 to the first side. The air between the compression board 21 and the inner end surface 112*b* is compressed. Thus, the compressed air is second generated. The generated compressed air is released to the outside of the compressor 1A via the outlet 113. The compressed air is second generated by compressing the air from the position X2 to the origin point. Thus, an amount of the compressed air second ejected is smaller than an amount of the compressed air first ejected.

As illustrated in the lower drawing in FIG. 15, the piston 20 stops by collision of the compression board 21 with the inner end surface 112*b*. At that time, a position of the piston 20 is 0 (zero).

The pinion 342 continues the rotary motion in a time period in which the piston 20 moves from the position X2 to the origin point. In that time period, the flat region 37 of the pinion 342 (see FIG. 12) faces the rack 24. Therefore, the pinion 342 does not contact the rack 24 in the time period in which the piston 20 moves from the position X2 to the origin point.

(Move of the Piston 20 to the Initial Position)

Figure 16:
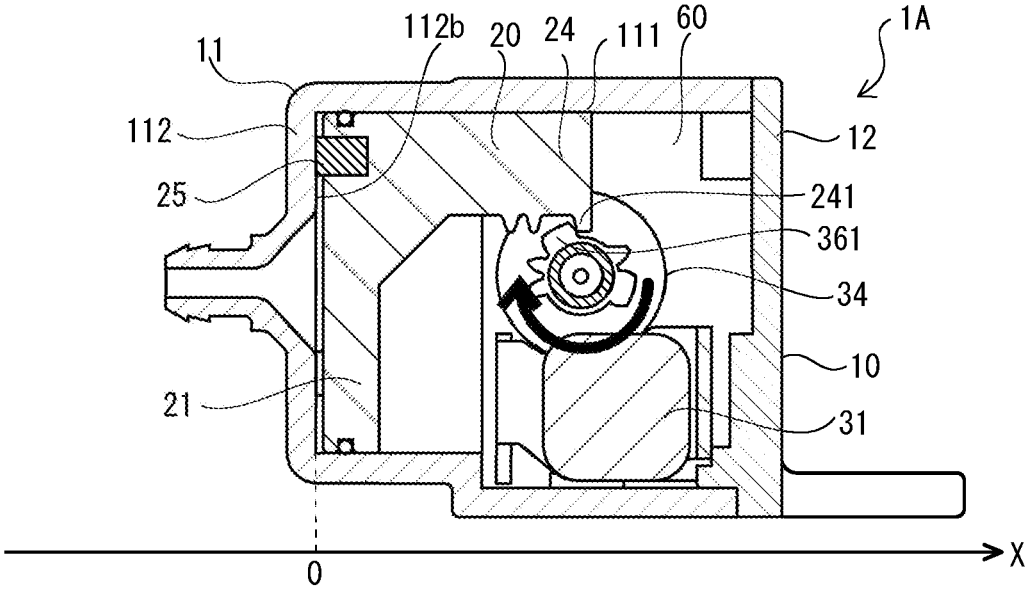
FIG. 16 illustrates a positional relationship between the rack and the pinion when the piston illustrated in FIG. 5 returns to an initial position.

FIG. 16 illustrates a positional relationship between the rack 24 and the pinion 342 when the piston 20 returns to the initial position. After the second generation of the compressed air is completed, the controller 1D controls the motor 31 to work continuously. Thus, the pinion 342 continues the clockwise rotary motion. As illustrated in FIG. 16, amongst from the pinion teeth 360 formed on the toothed region 36 of the pinion 342, the leading tooth 361 first contacts the rack 24. More specifically, the leading tooth 361 contacts the rack tooth 241. Then, the pinion teeth 360 formed on the toothed region 36 of the pinion 342 are engaged with the rack teeth 241 to 243. Thus, the piston 20 moves in the axis direction toward the second side.

The number of the pinion teeth 360 formed on the toothed region 36 is greater than the number of the pinion teeth 380 formed on the toothed region 38. Since the pinion teeth 360 are engaged with the rack teeth 241 to 243, the piston 20 moves in the axis direction toward the second side further than the position X2. In other words, the compression board 21 reaches the position X1.

Since the switch 70 is provided to the position X1, the switch 70 changes from On to Off. When the detection signal from the switch 70 is changed to On, the controller 1D determines that the piston 20 reaches the initial position, and then stops the motor 31. Once the motor 31 stops, the pinion 342 stops the rotary motion. When the pinion 342 stops the rotary motion, the piston 20 stops in a state in which the end tooth 363 contacts the rack tooth 243, as illustrated in the upper drawing in FIG. 14. As illustrated in the upper drawing in FIG. 14, when the end tooth 363 contacts the rack tooth 243, the position of the piston 20 is the position X1. Thus, the piston 20 stops in the initial position.

4. Effect (Change in an Ejection Amount of the Compressed Air)

As illustrated in FIG. 12, the toothed region and the flat region are alternately provided to the pinion 342. Moreover, the number of the pinion teeth 360 formed on the toothed region 36 is greater than the number of the pinion teeth 380 formed on the toothed region 38. Thus, an ejection amount of the compressed air can be changed by control of the motor 31 such that the pinion 342 makes one turn of the rotary motion.

When the rack teeth 240 are engaged with the pinion teeth 360 formed on the toothed region 36, the piston 20 moves from the origin point to the position X1. When the rack teeth 240 are engaged with the pinion teeth 380 formed on the toothed region 38, the piston 20 moves from the origin point to the position X2. Since the distance between the origin point and the position X1 is greater than the distance between the origin point and the position X2, an amount of the first generated compressed air is greater than an amount of the second generated compressed air.

In a case where the controller 1D causes the pinion 342 to make the one turn of the rotary motion, the controller 1D continuously rotates the motor 31 in one direction. The pinion 342 is provided to the compressor 1A. Thus, it is possible for the controller 1D to change the ejection amount of the compressed air by a simple control. An object attached on the lens of the camera 3 can be removed easily by changing the ejection amount of the compressed air.

(Improved Accuracy in Stop in the Initial Position)

The size of the tooth tip 363*a* of the end tooth 363 in the circumferential direction is greater than the size of the tooth tip 362*a* of the middle tooth 362 in the circumferential direction. Thus, accuracy in stop of the piston 20 in the initial position can be improved. Details of the improvement will be described below.

When the switch 70 is turned on, the motor 31 does not stop immediately. A difference occurs between the initial position of the piston 20 and an actual position in which the piston 20 has stopped due to variability of a time period from a time point at which the switch 70 is turned on to a time point at which the motor 31 actually stops. In a case where the contact of the tooth tip 363*a* of the end tooth 363 with the rack tooth 243 is released due to the difference, a third generation of the compressed air is performed. In a next operation, the compressor 1A needs to move the piston 20 in the axis direction toward the second side. Thus, it is impossible to generate the compressed air immediately.

In the compressor 1A, the size of the tooth tip 363*a* of the end tooth 363 in the circumferential direction is greater than the size of the tooth tip 362*a* of the middle tooth 362 in the circumferential direction. Therefore, even in a case where the difference occurs between the initial position of the piston 20 and the actual position in which the piston 20 has stopped, the tooth tip 363*a* can contact the rack tooth 243. Thus, even if the actual position in which the piston 20 has stopped is different from the initial position of the piston 20, the end tooth 363 functions as the movement prevention tooth that prevents the piston 20 from moving. The end tooth 382 also functions as the movement prevention tooth, like the end tooth 363. Therefore, the compressor 1A generates the compressed air immediately in the next operation.

(Improvement in Strength of the Rack Teeth)

Strength of the rack tooth 241 can be improved by making a tooth thickness T1 of the rack tooth 241 thicker than a tooth thickness T2 of the rack tooth 242 and a tooth thickness T3 of the rack tooth 243. In a case where the pinion 342 rotates clockwise, the pinion 342 first contacts the rack tooth 241 among the rack teeth 241 to 243. Therefore, among the rack teeth 241 to 243, the rack tooth 241 receives a largest impact from the pinion 342. The strength of the rack tooth 241 can be improved by making the tooth thickness T1 of the rack tooth 241 greater than the tooth thickness T2 of the rack tooth 242 and the tooth thickness T3 of the rack tooth 243. Thus, the rack tooth 241 is prevented from breaking.

(Improvement in Strength of the Pinion)

As illustrated in FIG. 12, the leading teeth formed on the toothed regions 36 and 38 of the pinion 342 have tooth thicknesses greater than tooth thicknesses of the pinion teeth other than the leading teeth. In a case where the pinion 342 rotates clockwise, the leading tooth first contacts the rack 24 among the pinion teeth formed on the toothed regions.

Among the pinion teeth formed on the toothed regions, the leading tooth receives a largest impact from the rack 24. Therefore, the strength of the leading teeth is improved by making a tooth thickness of the leading tooth greater than tooth thicknesses of other pinion tooth. Thus, the leading tooth is prevented from breaking.

(Control of Mismatched Engagement)

As illustrated in FIG. 13, a width G1 of a space between the rack tooth 241 and the rack tooth 242 is greater than a width G2 of a space between the rack tooth 242 and the rack tooth 243. Thus, mismatched engagement between the rack 24 and the pinion 342 can be prevented.

As described above, when the pinion 342 rotates clockwise, the leading tooth of the pinion 342 comes into contact with the rack tooth 241. In a case where a pitch of the rack teeth 240 is equal, the leading tooth of the pinion 342 may contact a tooth other than the rack tooth 241, depending on the position of the piston 20. Thus, the rack 24 and the pinion 342 may be not in mesh. Since a distance that the piston 20 moves is changed when the rack 24 and the pinion 342 are out of mesh, the amount of the compressed air is unintentionally changed.

However, the leading tooth is prevented from contacting a rack tooth other than the rack tooth 241 by making the width G1 of the space between the rack teeth 241 and 242 greater than the width G2 of the space between the rack teeth 242 and 243. Thus, mismatch between the rack 24 and the pinion 342 can be prevented. Accordingly, an unintentional change in the amount of the generated compressed air can be prevented.

5. Modifications

In the foregoing embodiment, the piston 20 includes the countershaft bush 23. However, the configuration of the piston 20 is not limited to this. The piston 20 may not include the countershaft bush 23. Even in this case, the drive 30 can be placed in the drive arrangement space. Thus, the compressor 1A can be downsized.

In the foregoing embodiment, the countershaft bush 23 is located outside the compression board 21 as viewed in the axis direction. However, the configuration of the countershaft bush 23 is not limited to this. The countershaft bush 23 may be located inside the compression board 21 or above across an end of the compression board 21 as viewed in the axis direction. Even in this case, the piston 20 is guided by the main shaft bush 22 and the countershaft bush 23 to move in the axis direction. Thus, the piston 20 is prevented from tilting relative to the axis direction.

In the foregoing embodiment, the main shaft bush 22 is away from the center of the compression board 21 as viewed in the axis direction. However, the configuration is not limited to this. The position of the main shaft bush 22 may match the center of the compression board 21 as viewed in the axis direction. Even in this case, the drive arrangement space is secured. Thus, the compressor 1A can be downsized.

In the foregoing embodiment, the initial position of the piston 20 is a position in which the end tooth 363 of the pinion 342 contacts the rack tooth 243. However, the initial position of the piston 20 is not limited to this. The initial position of the piston 20 may be a position of the end tooth 382 formed on the toothed region 38 of the pinion 342, or may be a position of one of the leading teeth formed on the toothed regions 36 and 38.

In the foregoing embodiment, the size of the tooth tip 363*a* of the end tooth 363 in the circumferential direction is greater than the size of the tooth tip 362*a* of the middle tooth 362 in the circumferential direction. However, the size of the tooth tip 363*a* of the end tooth 363 is not limited to this. The size of the tooth tip 363*a* in the circumferential direction may be the same as the size of the tooth tip 362*a* in the circumferential direction.

In the foregoing embodiment, the tooth thickness T1 of the rack tooth 241 is greater than the tooth thickness T2 of the rack tooth 242 and the tooth thickness T3 of the rack tooth 243. However, the tooth thicknesses are not limited to the foregoing embodiment. The tooth thickness T1 of the rack tooth 241 is the same as a tooth thickness of another tooth.

In the foregoing embodiment, the tooth thickness of the leading teeth formed on the toothed regions 36 and 38 are greater than the tooth thicknesses of other pinion teeth. However, the tooth thickness of the leading tooth is not limited to this. Tooth thicknesses of the leading teeth on the toothed regions 36 and 38 may be the same as a tooth thickness of another pinion tooth.

In the foregoing embodiment, the width G1 of the space between the rack tooth 241 and the rack tooth 242 is greater than the width G2 of the space between the rack tooth 242 and the rack tooth 243. However, the width of the space between teeth is not limited to this. Pitch between the rack teeth 240 may be constant.

In the foregoing embodiment, the compressor 1A compresses the air. However, the configuration is not limited to this. The compressor 1A may compress and eject fluid. In addition to the air, the fluid includes gas other than air and liquid, such as water and wash solution.

In a case where the compressor 1A ejects liquid, the compressor 1A further includes a tank to hold the liquid. The through hole 112*a* and another through hole are provided to a side wall of the compressing portion 112. One end of the hose 1B and one end of the another hose are inserted into those through holes. Another end of the another hose is connected to the tank. A valve is provided to each of the through hole 112*a* and the another through hole. In a case where the piston 20 moves in the axis direction toward the second side, the valve provided to the through hole 112*a* is closed, and the valve provided to the another through hole is opened. Thus, the liquid held in the tank is drawn into the compressing portion 112. In a case where the piston 20 moves in the axis direction toward the first side, the valve provided to the through hole 112*a* is opened, and the valve provided to the another through hole is closed. Thus, the liquid that is drawn into the compressing portion 112 is ejected via the through hole 112*a*.

The embodiment of this invention is described above. The foregoing embodiment is only an example to implement the invention. Therefore, the invention is not limited by the foregoing embodiment. It is possible to properly change the embodiment to implement the invention without departing from the purpose of the invention.

While the invention has been shown and described in detail, the foregoing description is in all aspects illustrative and not restrictive. It is therefore understood that numerous other modifications and variations can be devised without departing from the scope of the invention.

What is claimed is:

1. A compressor comprising:

a case;

a piston that is housed in the case, and that moves along an axis direction;

an elastic member that is housed in the case, and that applies a force to the piston to move the piston in the axis direction toward a first side of the case; and a drive that causes the piston to move in the axis direction toward a second side of the case, the second side being opposite the first side; wherein:

the piston includes a rack that extends in the axis direction;

the drive includes:

a motor; and a pinion that rotates in accordance with a rotary motion of the motor, and that is engaged with the rack;

the pinion includes:

a first toothed region and a second toothed region each on which a pinion tooth is formed; and first and second flat regions on which no pinion tooth is formed, the first and second flat regions being provided between the first and second toothed regions; and a number of the pinion teeth that are formed on the first toothed region is greater than a number of the pinion teeth that are formed on the second toothed region;

the pinion and the rack are configured so that when the piston approaches an end portion of the case on the first side in the axis direction, a first rack tooth first contacts the pinion, the first rack tooth being located furthest on the second side in the axis direction among rack teeth that are formed on the rack, and a tooth thickness in the axis direction of the first rack tooth is greatest among the rack teeth of the rack.

2. A compressor comprising:

a case;

a piston that is housed in the case, and that moves along an axis direction;

an elastic member that is housed in the case, and that applies a force to the piston to move the piston in the axis direction toward a first side of the case; and a drive that causes the piston to move in the axis direction toward a second side of the case, the second side being opposite the first side; wherein:

the piston includes a rack that extends in the axis direction;

the drive includes:

a motor; and a pinion that rotates in accordance with a rotary motion of the motor, and that is engaged with the rack;

the pinion includes:

a first toothed region and a second toothed region each on which a pinion tooth is formed; and first and second flat regions on which no pinion tooth is formed, the first and second flat regions being provided between the first and second toothed regions; and a number of the pinion teeth that are formed on the first toothed region is greater than a number of the pinion teeth that are formed on the second toothed region;

the pinion teeth formed on the first toothed region include a movement prevention tooth having a tooth tip that contacts a rack tooth after the motor has been stopped at a predetermined position in the axis direction, the rack tooth being formed on the rack; and a length in a circumferential direction of the pinion of the tooth tip of the movement prevention tooth is greater than a length in the circumferential direction of the pinion of a tooth tip of at least one of the pinion teeth other than the movement prevention tooth formed on the first toothed region.

3. A compressor comprising:

a case;

a piston that is housed in the case, and that moves along an axis direction;

an elastic member that is housed in the case, and that applies a force to the piston to move the piston in the axis direction toward a first side of the case; and a drive that causes the piston to move in the axis direction toward a second side of the case, the second side being opposite the first side; wherein:

the piston includes a rack that extends in the axis direction;

the drive includes:

a motor; and a pinion that rotates in accordance with a rotary motion of the motor, and that is engaged with the rack;

the pinion includes:

a first toothed region and a second toothed region each on which a pinion tooth is formed; and first and second flat regions on which no pinion tooth is formed, the first and second flat regions being provided between the first and second toothed regions; and a number of the pinion teeth that are formed on the first toothed region is greater than a number of the pinion teeth that are formed on the second toothed region, wherein the compressor further comprises a controller configured to control the motor to intermittently rotate the pinion with either the first toothed region or the second toothed region, wherein (i) rotating the pinion with the first toothed region causes the piston to move toward the second side by a first distance, and (ii) rotating the pinion with the second toothed region causes the piston to move toward the second side by a second distance that is less than the first distance, so that a greater amount of gas is emitted by the compressor when the pinion is rotated by the first toothed region compared to when the pinion is rotated by the second toothed region.

4. The compressor according to claim 3, wherein all gaps between the teeth formed on the first toothed region are shorter than circumferential lengths of the first and second flat regions.

5. The compressor according to claim 3, wherein the rack includes:

a first rack tooth that is located furthest on the second side in the axis direction;

a second rack tooth that is adjacent to the first rack tooth; and a third rack tooth that is adjacent to the second rack tooth; wherein a width in the axis direction of a first space between the first rack tooth and the second rack tooth is greater than a width in the axis direction of a second space between the second rack tooth and the third rack tooth.

6. The compressor according to claim 5, wherein among the pinion teeth formed on the first toothed region, a thickness in a circumferential direction of the pinion of a tooth that first contacts the rack is greater than a thickness in the circumferential direction of the pinion of a tooth adjacent to the tooth that first contacts the rack.

* * * * *